US006948248B2

(12) United States Patent
Andis et al.

(10) Patent No.: US 6,948,248 B2
(45) Date of Patent: Sep. 27, 2005

(54) HAIR TRIMMER

(75) Inventors: Matthew L. Andis, Racine, WI (US); Richard J. Tringali, Racine, WI (US); Robert E. Derby, Racine, WI (US)

(73) Assignee: Andis Company, Sturtevant, WI (US)

( * ) Notice: Subject to any disclaimer, the term of this patent is extended or adjusted under 35 U.S.C. 154(b) by 67 days.

(21) Appl. No.: 10/285,390

(22) Filed: Oct. 31, 2002

(65) Prior Publication Data

US 2004/0083613 A1 May 6, 2004

(51) Int. Cl.[7] ..... B26B 19/00
(52) U.S. Cl. ..... 30/34.05; 30/195
(58) Field of Search ..... 30/34.05, 195, 30/43.92, 133, 208, 43.9, 43.6

(56) References Cited

U.S. PATENT DOCUMENTS 3,604,915 A * 9/1971 Wahl ..... 362/115
4,811,159 A * 3/1989 Foster, Jr. ..... 361/231
5,075,971 A 12/1991 McCambridge
5,367,772 A * 11/1994 Ogawa ..... 30/201
5,612,849 A * 3/1997 Prehodka et al. ..... 361/213
5,699,616 A * 12/1997 Ogawa ..... 30/201
5,724,736 A 3/1998 Smith
5,805,406 A * 9/1998 Mailand ..... 361/212
5,924,202 A 7/1999 Romani
5,975,090 A * 11/1999 Taylor et al. ..... 132/116
6,188,837 B1 2/2001 Kwan
6,191,930 B1 * 2/2001 Ramchandani ..... 361/213
6,314,648 B1 * 11/2001 Hillebrandt ..... 30/208
6,393,718 B1 * 5/2002 Harris et al. ..... 34/96
6,640,049 B1 * 10/2003 Lee et al. ..... 392/385
2002/0073549 A1 6/2002 McCambridge et al.
2002/0108255 A1 * 8/2002 Degregorio, Jr. ..... 30/133

* cited by examiner

*Primary Examiner*—Allan N. Shoap
*Assistant Examiner*—Phong Nguyen
(74) *Attorney, Agent, or Firm*—Michael, Best & Friedrich LLP

(57) ABSTRACT

A hair trimmer having an ion emitter assembly that emits ions for use in hair care processes. The hair trimmer includes a body portion having a cutting end, a blade set mounted adjacent the cutting end, and an electric motor drivingly connected to the blade set. The body portion defines a cavity and the ion emitter assembly is at least partially mounted in the cavity.

20 Claims, 7 Drawing Sheets

HAIR TRIMMER

BACKGROUND OF THE INVENTION

The invention relates to methods and apparatus for trimming hair.

Various methods and apparatus for trimming hair have been used in the past. Nevertheless, a new method and apparatus for trimming hair that provides enhanced hair care results would be welcomed by those that utilize hair trimmers.

SUMMARY OF THE INVENTION

The present invention provides a hair trimmer having an ion emitting assembly.

In one embodiment, the invention provides a hair trimmer that includes a body portion having a cutting end, a blade set mounted adjacent the cutting end, an electric motor drivingly connected to the blade set, and an ion emitter assembly coupled to the body.

In another embodiment, the invention provides a hair trimmer that includes a body portion having a cutting end, a blade set mounted adjacent the cutting end, an electric motor housed within the body portion and operatively engageable with the blade set, an ionizer coupled to the body portion and adapted to receive an input power, and an electrode coupled to the body portion adjacent the cutting end and adapted to receive an output power from the ionizer, wherein the electrode emits ions that flow generally toward the cutting end.

In yet another embodiment, the invention provides a hair trimmer configured to trim hair and reduce a static charge of the hair as the hair is trimmed. The hair trimmer includes a body portion having a cutting end and defining an inner cavity, a selectively operable electric motor mounted in the inner cavity and adapted to receive a motor input power, a blade set mounted to the cutting end and including a fixed blade and a reciprocating blade that is operatively engageable with the electric motor for selective reciprocation of the reciprocating blade to cut a length of hair as the blade set passes through the hair, an ion emitting assembly at least partially mounted within the inner cavity and including an ionizer adapted to receive an ionizer input power and an electrode mounted between the electric motor and the blade set, the electrode electrically coupled to and adapted to receive an output power from the ionizer to emit ions, and a shroud portion protruding from the body portion and defining an opening communicating with the inner cavity, the opening facing generally toward the cutting end wherein ions emitted from the electrode pass through the opening and flow generally toward the cutting end to reduce the static charge of the hair as the hair is cut.

Further objects of the present invention together with the organization and manner of operation thereof, will become apparent from the following detailed description of the invention when taken in conjunction with the accompanying drawings wherein like elements have like numerals throughout the drawings.

Figure 1:
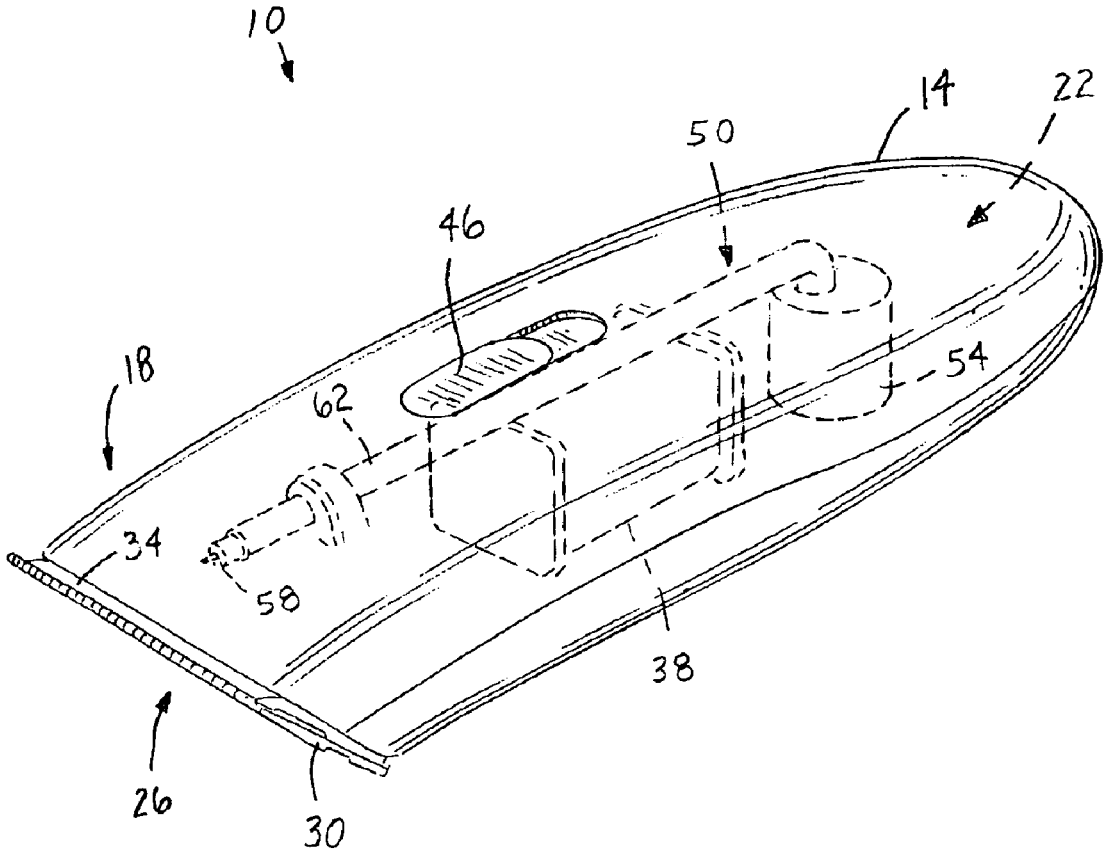
FIG. 1 is a perspective view of a hair trimmer of the present invention.
Figure 2:
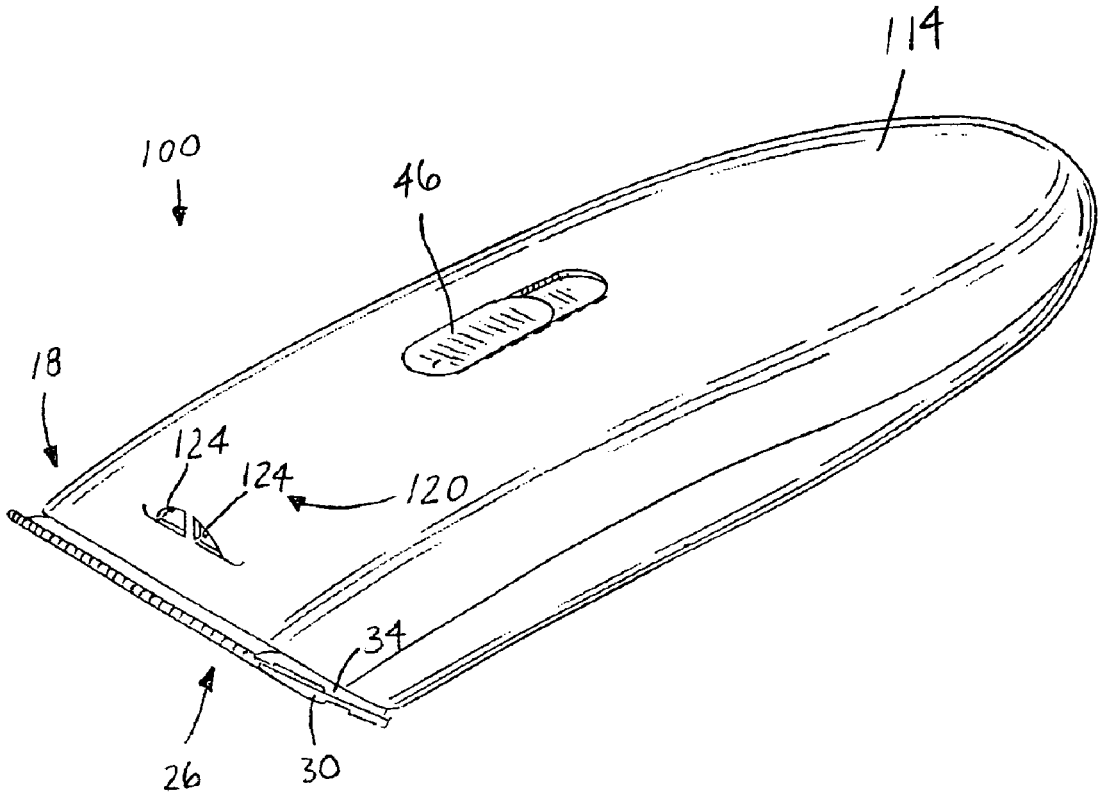
FIG. 2 is a perspective view of another hair trimmer of the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. Unless specified or limited otherwise, the terms "mounted," "connected," and "coupled" are used broadly and encompass both direct and indirect mountings, connections, and couplings. Further, "connected" and "coupled" are not restricted to physical or mechanical connections or couplings. The use of letters to identify elements of a method or process is simply for identification and is not meant to indicate that the elements should be performed in a particular order.

DETAILED DESCRIPTION

Figure 3:
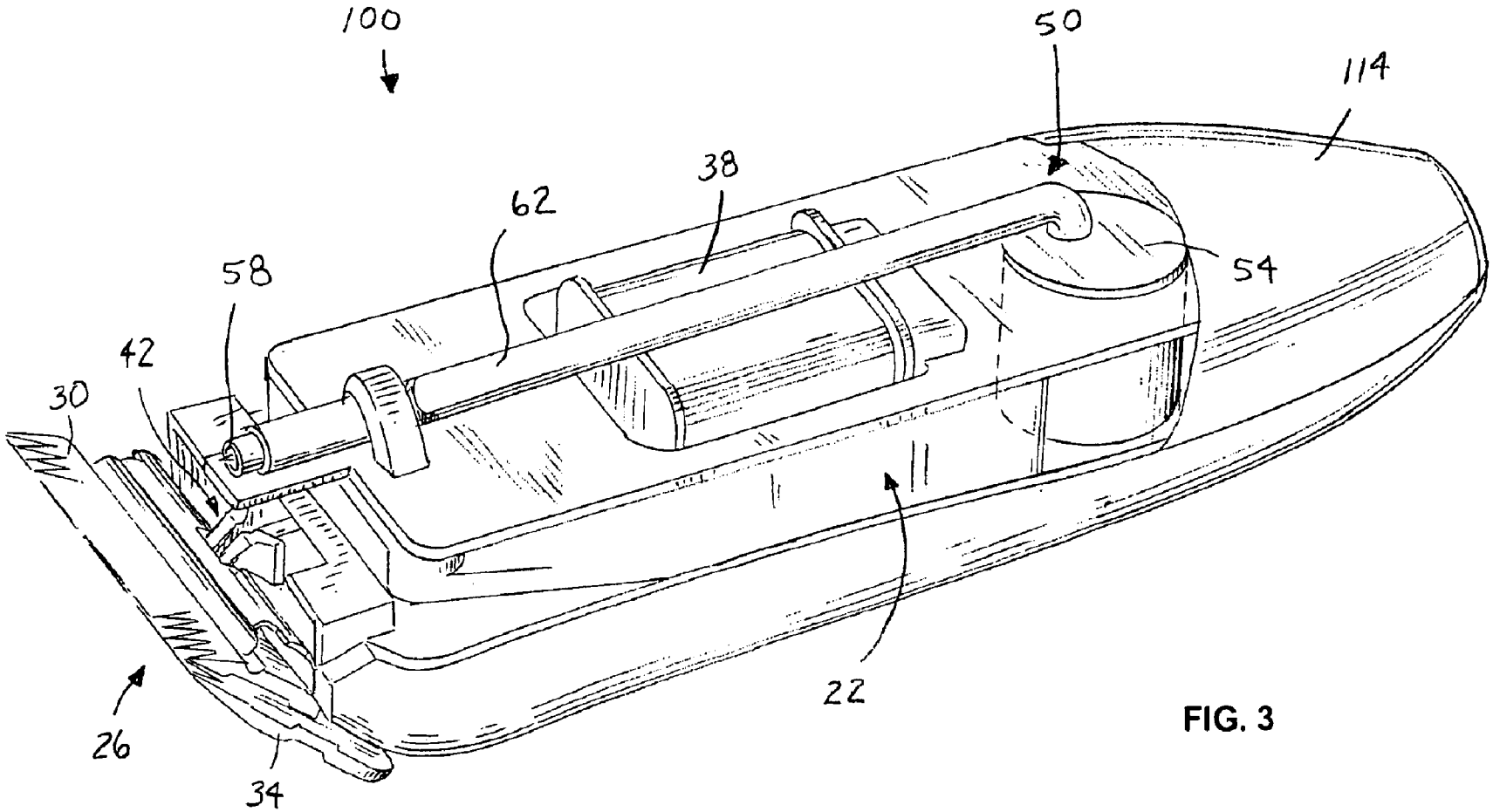
FIG. 3 is a perspective view of the hair trimmer of FIG. 2 with a portion cut away.
Figure 4:
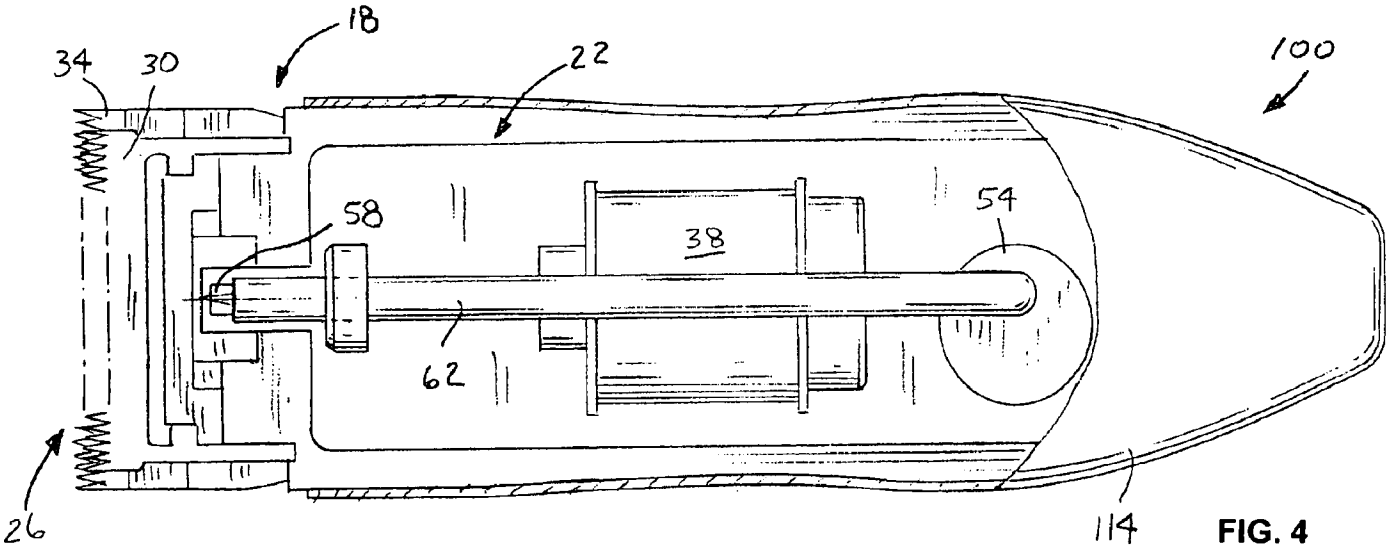
FIG. 4 is a top view of the hair trimmer of FIG. 2 with a portion cut away.
Figure 5:
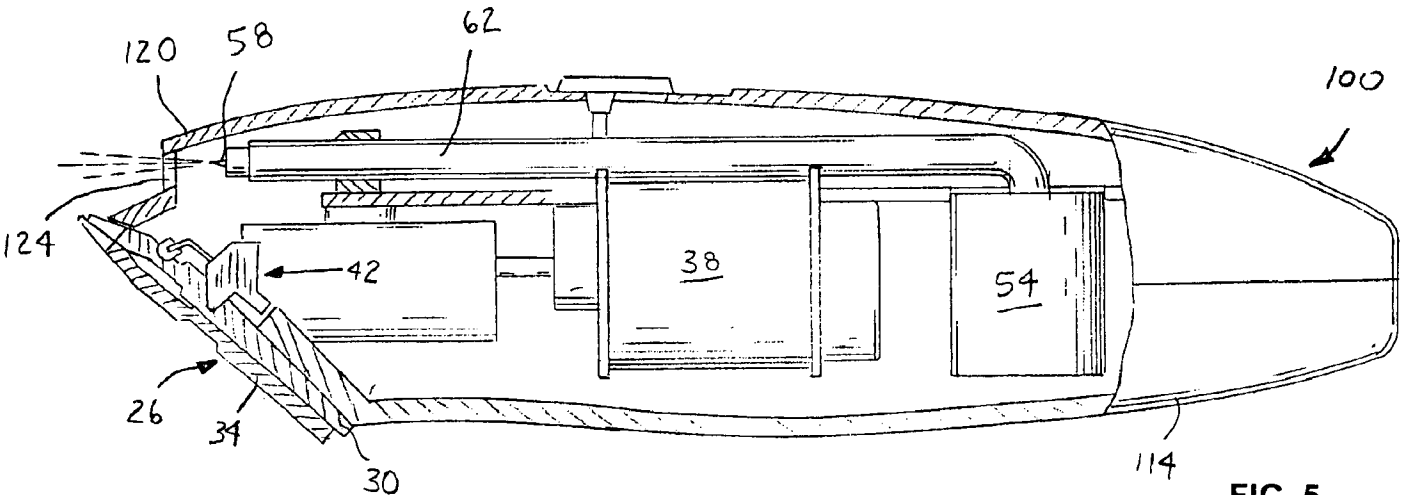
FIG. 5 is a side view of the hair trimmer of FIG. 2 with a portion cut away.

FIG. 1 illustrates a hair trimmer or clipper 10 of the present invention. The hair trimmer 10 includes a hollow, elongated body portion 14 having a cutting end 18 and defining an inner cavity 22. The elongated body 14 supports a blade set 26 on the cutting end 18. The blade set 26 includes a fixed blade 30 mounted on the body portion 14 and a reciprocating blade 34 biased against and moveable with respect to the fixed blade 30 by a drive mechanism 42 (FIGS. 3 and 5). An electric motor or actuator 38 is mounted in the inner cavity 22 and is drivingly connected to the blade set 26 by the drive mechanism 42. The electric motor 38 effects reciprocation of the reciprocating blade 34 with respect to the fixed blade 30 in response to actuation of the motor 38. A user actuates the motor 38 using a power switch 46 provided on the body portion 14. The switch 46 is configured to interrupt the flow of electrical power from a power supply to the electric motor 38. The electrical power may include an alternating current (AC) power provided via a corded plug electrically coupled to a wall outlet and/or a direct current (DC) power provided by a battery (e.g., a rechargeable battery disposed in the cavity 22). Hair trimmers powered by AC and/or DC power are generally known in the art and, accordingly, are not discussed further herein. As the hair trimmer 10 is guided through a person's hair, the reciprocating motion of the blade set 26 cuts the person's hair. A number of suitable blades sets, motors, and driving arrangements are known. It should be appreciated that hair trimmers having other types of blade sets, motors, and/or driving arrangements would be suitable for use in combination with the present invention.

The hair trimmer 10 includes an ion emitting assembly 50 having an ionizer 54, an ion emitting electrode 58, and an ion lead 62 that electrically couples the ionizer 54 and the electrode 58. In some embodiments, as illustrated in FIG. 1, the ionizer 38 is mounted in the cavity 22 and the electrode 42 is mounted near the cutting end 18. In other embodiments, the components 54, 58, and 62 of the ionizer 38 may be alternatively positioned (e.g., the components 54, 58, and 62, or portions thereof, may be mounted alternatively inside the cavity, outside the cavity, or a combination thereof).

For operation, the ionizer 54 receives an ionizer input power from a power source. Similar to the motor 38, the ionizer input power may include an AC power and/or a DC power. In some embodiments, the input power of the motor 38 may be substantially similar to the ionizer input power. In one embodiment, the ionizer input power is provided to the ionizer 54 when the user actuates the switch 46 to an ON position. In another embodiment, a separate ionizer switch (not shown) is provided on the body portion 14. The ionizer switch is configured to interrupt the flow of electrical power (i.e., the ionizer input power) from a power supply to the ionizer 54. Utilization of a separate ionizer switch allows a user to control the ion emitting assembly 50 independent of the motor 38.

The ionizer 54 utilizes the ionizer input power to generate an ionizer output power. In most embodiments, the ionizer output power is a high voltage, low current power. In one embodiment, the ionizer input power is a 120 volt AC power, which is the standard residential electrical service provided in the United States, and the ionizer output power includes a voltage between approximately negative 3.3 kilo-volts DC and negative 4.8 kilo-volts DC and a current of approximately 50 micro-amps. In other embodiments, alternative values of ionizer input and output powers are possible depending on the specific configuration of the ionizer 54.

The electrode 58 receives the ionizer output voltage from the ionizer 54 via the ion lead 62 and emits ions. The length of the ion lead 62 may vary based on location of the electrode 58 with respect to the ionizer 54. In some embodiments, the need for the ion lead 62 may be obviated. In the illustrated embodiment, the ions emitted from the electrode 58 are negative ions. The emitted negative ions are utilized to facilitate hair care process as discussed further below. While the illustrated embodiments are described as emitting negative ions for use in hair care processes, positive ions may be emitted in place of, or in combination with, the negative ions. Additionally, although the illustrated electrode 58 is a needle electrode, other embodiments of the electrode 58 may include alternative shapes (e.g., a plate electrode) and sizes.

In one embodiment, the ion emitting assembly 54 includes ion generator model number SW750H-8 provided by Seawise Industrial Ltd. of Kowloon Hong Kong. The Seawise ion generator utilizes an input power having a voltage of 120 volts AC to generate an output power having a maximum negative voltage of approximately negative 7.5 kilo-volts DC and current of approximately 50 micro-amps. The Seawise ion generator generates negative ions. In other embodiments, the ion emitting assembly 54 may include other configurations of ion generators.

FIGS. 2–5 illustrate a hair trimmer 100. The hair trimmer 100 is similar to the hair trimmer 10 and like parts are identified using the same reference numerals. The hair trimmer 100 includes a body portion 114 that includes a shroud portion 120. The shroud portion 120 defines openings 124 that communicate with the inner cavity 22 and open toward the cutting end 18. The shroud portion 120 substantially surrounds the electrode 58 such that ions emitted from the electrode 58 pass through the openings 124 and flow generally toward the cutting end 18.

In one embodiment, the ions emitted by the electrode 58 of the hair trimmer 100 substantially reduce or eliminate static electricity on a person's hair as the hair trimmer 100 is used to trim the person's hair. Static electricity may cause a person's hair to stand on end, making the hair difficult to manage as well as aesthetically displeasing. Static electricity may be generated due to the motion of a hair trimmer and/or combs and brushes through a person's hair. Additionally, static electricity may be alternatively generated on a person's hair.

As a person's hair is trimmed, the ions emitted from the electrode 58 may be passively and/or actively moved to a person's hair.

In one embodiment, the ions are passively moved to the person's hair via an "ionic wind". As the ions are emitted from the electrode 58, the emitted ions move outward away from the electrode 58. The continuous movement of ions away from the electrode is known as an "ionic wind". In some embodiments, the emitted ions are attracted to an object (e.g., the person's hair) with an opposite polarity. The emitted ions travel through electric field lines away from the electrode 58 to the object. The ions then act to neutralize the opposite charge on the object. Neutralization of the opposite charge thereby reduces or eliminates static electricity. In other embodiments, the emitted ions are concentrated on an object, thereby creating a net positive or negative charge on the object.

Figure 6:
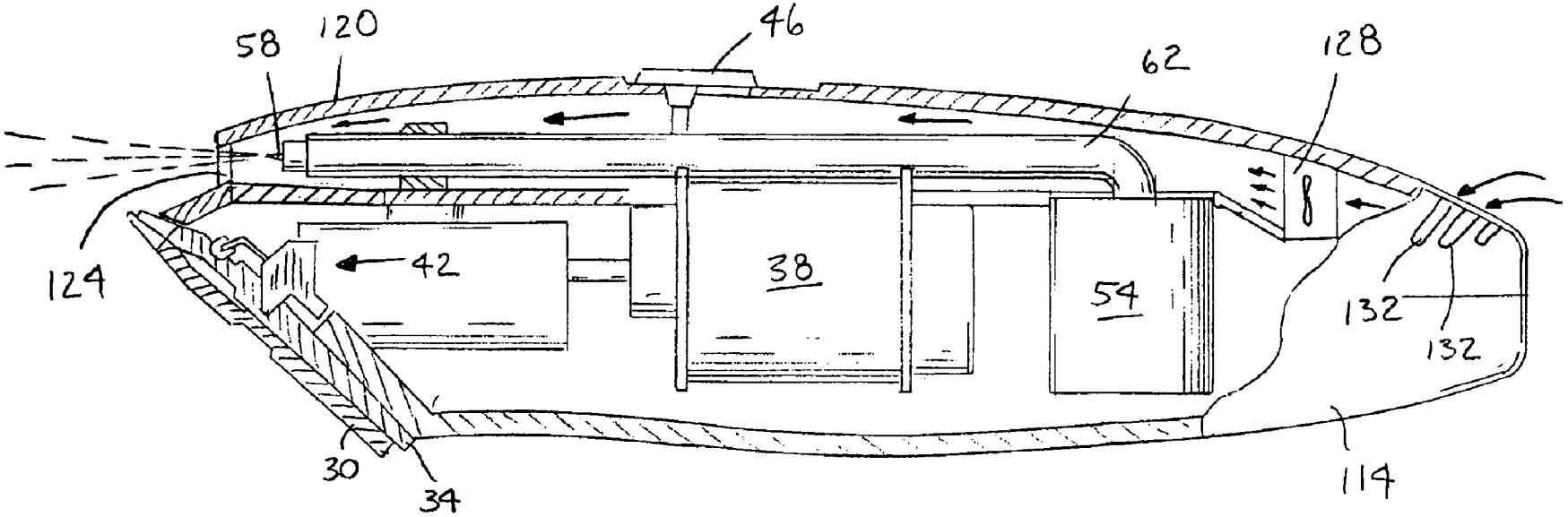
FIG. 6 is a side view similar to FIG. 5 showing an alternative construction of the hair trimmer of FIG. 2.

In another embodiment, as shown in FIG. 6, the hair trimmer 100 may include a fan 128 (schematically represented). The fan 128 is utilized to actively move the emitted ions away from the electrode 58 towards the person's hair. The fan 128 draws air in through air vents 132 and moves air through the cavity 22 past the electrode 58 and out the openings 124 in the shroud 120. The movement of air is represented in FIG. 6 with arrows. The cavity 22 may include structure to direct the flow of air through specific parts thereof. The fan 128 assists the passive movement of ions from the electrode 58. The ions are attracted to the person's hair for neutralization of the static electricity, or concentrated on an object resulting in a positive or negative charge on the object, in a similar fashion as discussed above with respect to the passive movement.

In one embodiment, the ions emitted by the electrode 58 of the hair trimmer 100 are utilized to charge the blade set 26 for attraction of the trimmed hairs 136. As the ions are emitted from the electrode 58, the emitted ions collect on the metal blade set 26, thereby charging the blade set 26. The charged blade set 26 attracts objects with an opposite polarity (e.g., the hairs 136 trimmed from a person's hair). As the hairs 136 are trimmed, they are attracted to the blade set 26, thereby reducing or eliminating the hairs 136 from falling on the floor or the person. The degree of charge on the blade set 26 may be controlled to optimize the amount of hair 136 that is attracted. In other embodiments, the blade set 26 is charged to a degree that repels hair from collecting on the blade set 26 but does not interfere with the hair trimming process.

In one embodiment, the ions emitted by the electrode 58 may substantially reduce or eliminate static electricity on a person's hair and charge the blade set 26 for attraction of the trimmed hairs 136. In other embodiments, portions of the blade set 26 are made of an insulating material (e.g., ceramic) to reduce the attraction of the hairs 136.

Figure 7:
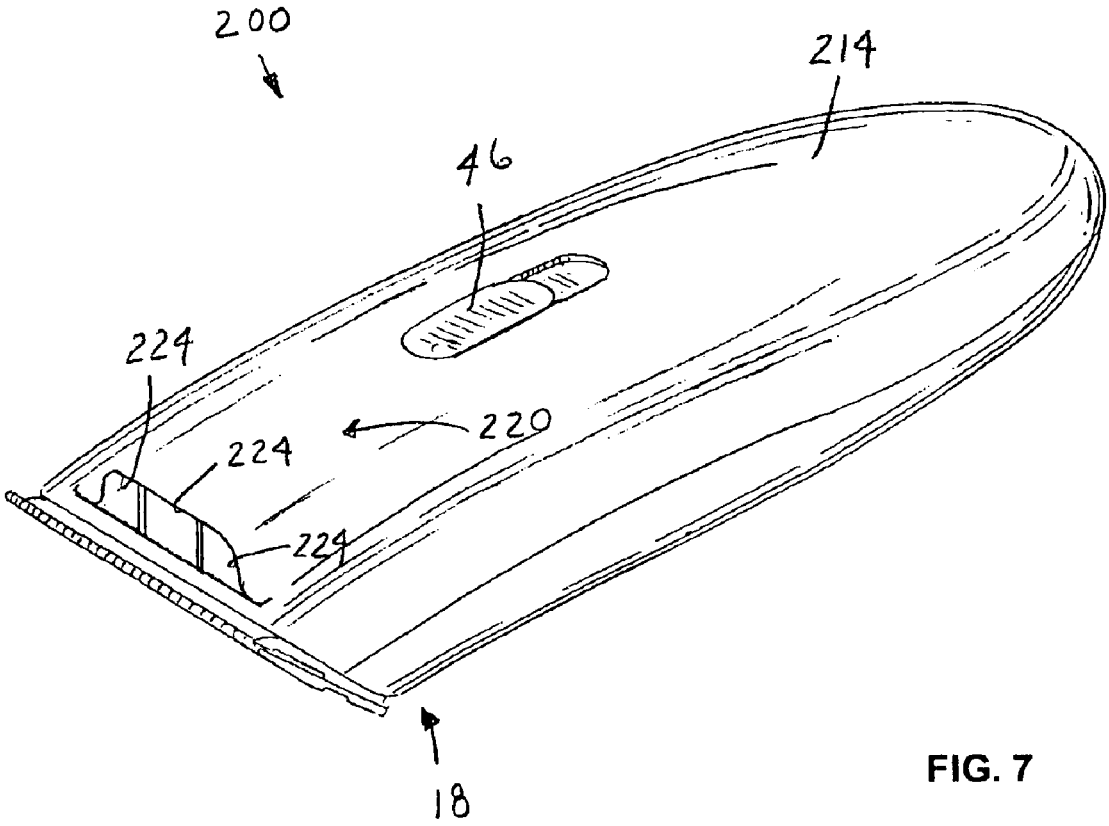
FIG. 7 is a perspective view of another hair trimmer of the present invention.
Figure 8:
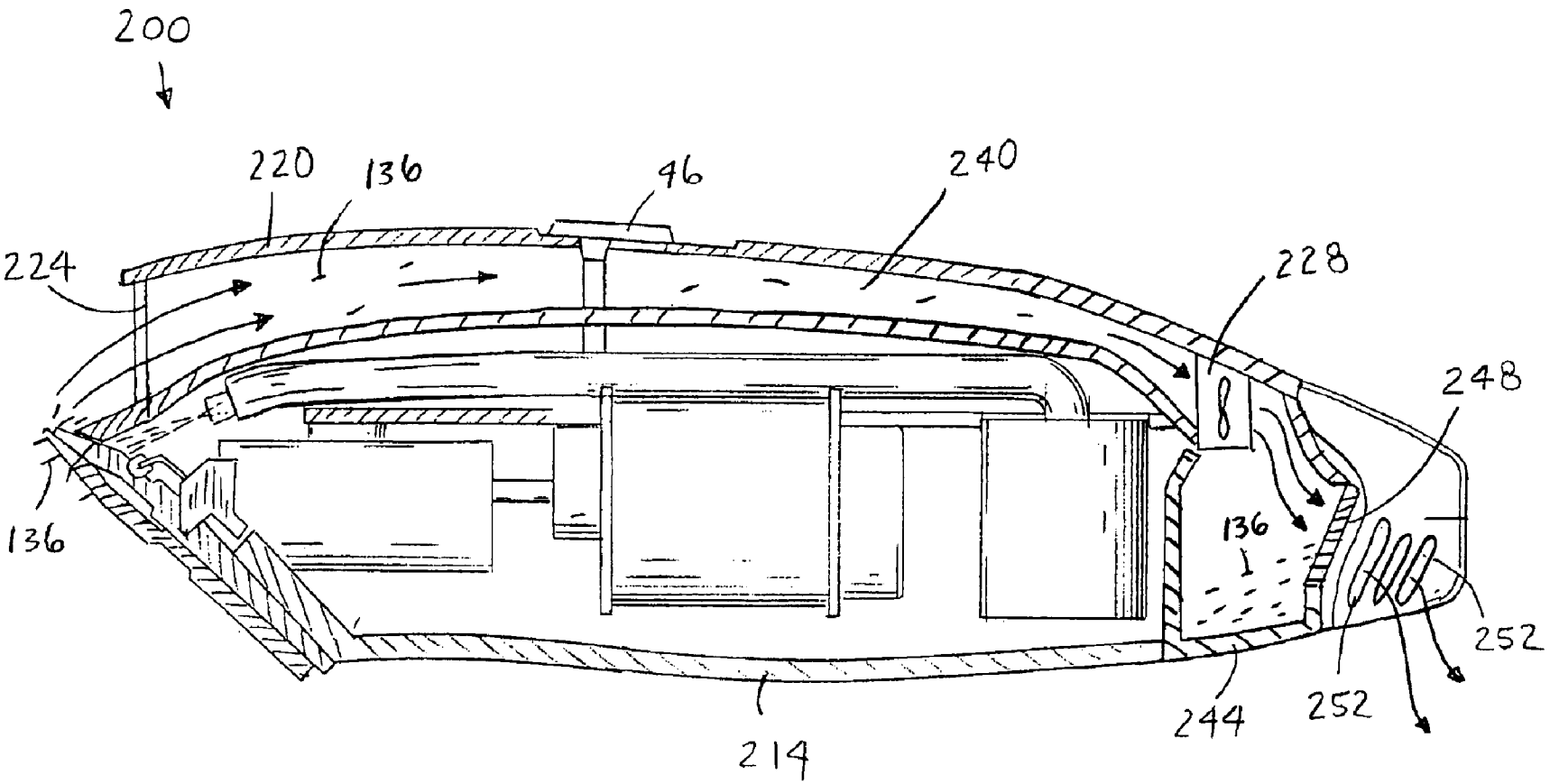
FIG. 8 is a side view of the hair trimmer of FIG. 7 with a portion cut away.

FIGS. 7–8 illustrate a hair trimmer 200. The hair trimmer 200 is similar to the hair trimmers 10 and 100 and like parts are identified using the same reference numerals. The hair trimmer 200 includes a body portion 214 that includes a shroud portion 220. The shroud portion 220 defines openings 224 that communicate with the inner cavity 22 and open toward the cutting end 18. The shroud portion 220 is disposed adjacent to the cutting portion of the blade set 26. In one embodiment, as shown in FIG. 8, the electrode 58 of the ion emitting assembly 50 is angled towards the inboard side of the fixed blade 30. The ions emitted from the electrode 58 are utilized to charge the blade set for attraction of trimmed hairs 136 as discussed above with respect to the hair trimmer 100. In other embodiments, a plate electrode is placed adjacent the inboard side of the fixed blade 30 for attraction of trimmed hairs 136 toward the blade set 26. As operation of the hair trimmer continues 200, a build-up of trimmed hairs 136 may form. The hair trimmer 200 includes a suction fan 228 (schematically illustrated) that draws air in to the openings 224. To prevent the hairs 136 from collecting around the operating portions of the hair trimmer 200, a conduit 240 is formed in the cavity 22 for movement of the hairs 136. The conduit 240 communicates with the openings 224. The fan 228 moves air in through the openings 224, through the conduit 240, past the fan 228, and into a collection chamber 244. The air carries hairs 136 through the conduit 240 as is schematically illustrated in FIG. 8.

The collection chamber (schematically illustrated) includes a filter 248 (e.g., a screen) sized to retain the hairs 136 in the collection chamber until the hairs 136 are cleaned out. The collection chamber 244 is designed to be removed from the body portion 214 for emptying. The filter 248 also allows air to travel out of the collection chamber 244 and through air vents 252. The movement of air is represented in FIG. 8 with arrows. The fan 228 acts as a vacuum to remove excess hairs 136 from the blade set 26, thereby enhancing the reduction or elimination of the hairs 136 from falling on the floor or the person. The vacuum action may also directly remove hairs 136 as they are cut by the blade set 26.

Other embodiments of the invention may utilize combinations of the above embodiments. Still other embodiments of the invention may utilize ions emitted from the electrode 58 for other hair care purposes.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A hair trimmer comprising:

a body portion having a cutting end, the body portion defining a cavity and an opening communicating with the cavity, wherein the opening is separate from the cutting end;

a blade set mounted adjacent the cutting end;

an electric motor drivingly connected to the blade set; and an ion emitter assembly at least partially mounted within the cavity and coupled to the body portion, wherein ions emitted from the ion emitter assembly pass through the opening and flow generally toward the cutting end.

2. The hair trimmer of claim 1, wherein the ion emitter assembly includes an ionizer adapted to receive an input power and generate an output power based at least in part on the input power; and an electrode adapted to receive the output power from the ionizer and emit ions.

3. The hair trimmer of claim 2, wherein an ion lead electrically couples the electrode to the ionizer.

4. The hair trimmer of claim 2, wherein the ionizer is mounted in the cavity.

5. The hair trimmer of claim 1, wherein the body portion includes a shroud portion defining the opening and the opening faces the cutting end.

6. The hair trimmer of claim 1, wherein the ions passing through the opening charge the blade set for attraction of cut portions of hairs trimmed by the hair trimmer.

7. The hair trimmer of claim 1, wherein the ions passing through the opening reduce a static charge on hair being trimmed by the hair trimmer.

8. The hair trimmer of claim 1, further comprising a fan, wherein the fan generates air flow, and wherein the air flow carries the emitted ions through the opening.

9. The hair trimmer of claim 2, wherein the input power is approximately 120 volts alternating current (AC) power, and wherein the output power includes a voltage between approximately negative 2.5 kilo-volts direct current (DC) and negative 7 kilo-volts DC.

10. The hair trimmer of claim 2, wherein the electrode emits negatively charged ions.

11. The hair trimmer of claim 2, wherein the electrode is between the blade set and the electric motor.

12. The hair trimmer of claim 2 wherein the electric motor receives an input power, and wherein the input power received by the electric motor is substantially similar to the input power received by the ionizer.

13. The hair trimmer of claim 8, wherein the fan is mounted in the cavity.

14. The hair trimmer of claim 13, wherein the body portion includes a shroud portion defining the opening adjacent a cutting portion of the blade set, and wherein the fan draws air and cut portions of hairs trimmed by the hair trimmer through the opening.

15. A hair trimmer comprising:

a body portion having a cutting end, the body portion defining a cavity and an opening communicating with the cavity, wherein the opening is separate from the cutting end;

a blade set mounted adjacent the cutting end;

an electric motor housed within the body portion and operatively engageable with the blade set;

an ionizer at least partially mounted in the cavity and adapted to receive an input power; and an electrode at least partially mounted in the cavity adjacent the cutting end and adapted to receive an output power from the ionizer, wherein the electrode emits ions that pass through the opening and flow generally toward the cutting end.

16. The hair trimmer of claim 15, wherein the body portion includes a shroud portion surrounding the electrode, the shroud portion defining the opening facing the cutting end.

17. The hair trimmer of claim 15, further comprising a fan mounted in the cavity.

18. The hair trimmer of claim 17, wherein the fan generates an air flow, and wherein the air flow carries the ions emitted from the electrode toward the cutting end.

19. The hair trimmer of claim 17, further comprising a collection chamber removably coupled to the body portion, wherein the fan generates an air flow, and wherein the air flow draws cut portions of hair trimmed by the hair trimmer toward the collection chamber.

20. A hair trimmer configured to trim hair and reduce a static charge of the hair as the hair is trimmed, the hair trimmer comprising:

a body portion having a cutting end and defining an inner cavity;

a selectively operable electric motor mounted in the inner cavity and adapted to receive a motor input power;

a blade set mounted to the cutting end and including a fixed blade and a reciprocating blade that is operatively engageable with the electric motor for selective reciprocation of the reciprocating blade to cut a length of hair as the blade set passes through the hair;

an ion emitting assembly at least partially mounted within the inner cavity and including an ionizer adapted to receive an ionizer input power and an electrode mounted between the electric motor and the blade set, the electrode electrically coupled to and adapted to receive an output power from the ionizer to emit ions; and a shroud portion protruding from the body portion and defining an opening communicating with the inner cavity, the opening facing generally toward the cutting end wherein ions emitted from the electrode pass through the opening and flow generally toward the cutting end to reduce the static charge of the hair as the hair is cut.

* * * * *